US010378473B2

(12) United States Patent
Ozaki

(10) Patent No.: US 10,378,473 B2
(45) Date of Patent: Aug. 13, 2019

(54) VEHICLE CONTROL DEVICE

(71) Applicant: DENSO CORPORATION, Kariya, Aichi-pref. (JP)

(72) Inventor: Chika Ozaki, Kariya (JP)

(73) Assignee: DENSO CORPORATION, Kariya (JP)

( * ) Notice: Subject to any disclaimer, the term of this patent is extended or adjusted under 35 U.S.C. 154(b) by 113 days.

(21) Appl. No.: 15/525,628

(22) PCT Filed: Feb. 2, 2016

(86) PCT No.: PCT/JP2016/000525
§ 371 (c)(1),
(2) Date: May 10, 2017

(87) PCT Pub. No.: WO2016/129243
PCT Pub. Date: Aug. 18, 2016

(65) Prior Publication Data

US 2017/0335785 A1 Nov. 23, 2017

(30) Foreign Application Priority Data

Feb. 11, 2015 (JP) ..... 2015-024842

(51) Int. Cl.
*F02D 41/22* (2006.01)
*G07C 5/08* (2006.01)
(Continued)

(52) U.S. Cl.
CPC ..... *F02D 41/222* (2013.01); *F02D 41/22* (2013.01); *F02D 41/266* (2013.01);
(Continued)

(58) Field of Classification Search
CPC ..... F02D 41/222; G07C 5/0808
See application file for complete search history.

(56) References Cited

U.S. PATENT DOCUMENTS 5,485,596 A * 1/1996 Igarashi ..... F02M 25/0809 701/101
5,880,361 A * 3/1999 Taniguchi ..... F02D 41/06 123/41.01
2013/0099793 A1* 4/2013 Shimizu ..... G01R 31/36 324/426

FOREIGN PATENT DOCUMENTS

JP 6-50851 2/1994
JP 2000-274300 10/2000
(Continued)

*Primary Examiner* — Calvin Cheung
(74) *Attorney, Agent, or Firm* — Nixon & Vanderhye P.C.

(57) ABSTRACT

An engine ECU is provided with an abnormality-diagnosis unit performing an abnormality diagnosis of an Air-Con ECU, and a monitoring IC monitoring the abnormality-diagnosis unit. The abnormality-diagnosis unit determines whether the output signal of the Air-Con ECU is normal based on the specified criterion value, so that the abnormality diagnosis of the Air-Con ECU is performed. The monitoring IC determines whether a criterion value is normal, which is used during the abnormality diagnosis of the Air-Con ECU. The abnormality-diagnosis unit performs an abnormality diagnosis of the monitoring IC. When the monitoring IC determines that the criterion value is abnormal or the abnormality-diagnosis unit determines that the monitoring IC is abnormal, the abnormality diagnosis of the Air-Con ECU is prohibited and a specified operation for abnormality is performed.

17 Claims, 3 Drawing Sheets

(51) Int. Cl.

| | |
|---|---|
| ***F02D 41/26*** | (2006.01) |
| *F01N 13/00* | (2010.01) |
| *F01P 11/16* | (2006.01) |
| *F02M 35/10* | (2006.01) |

(52) U.S. Cl.
CPC ..... *G07C 5/0808* (2013.01); *F01N 13/008* (2013.01); *F01P 11/16* (2013.01); *F01P 2025/32* (2013.01); *F02D 41/26* (2013.01); *F02D 2041/227* (2013.01); *F02D 2400/08* (2013.01); *F02M 35/1038* (2013.01)

(56) References Cited

FOREIGN PATENT DOCUMENTS

| | | |
|---|---|---|
| JP | 2011-32903 | 2/2011 |
| JP | 2012-96763 | 5/2012 |
| JP | 2013-169917 | 9/2013 |

* cited by examiner

VEHICLE CONTROL DEVICE

CROSS REFERENCE TO RELATED APPLICATION

This application is the U S. national phase of International Application No. PCT/JP2016/000525 filed Feb. 2, 2016 which designated the U.S. and claims priority to Japanese Patent Application No. 2015-24842 filed on Feb. 11, 2015, the entire contents of each of which are hereby incorporated herein by reference.

TECHNICAL FIELD

The present disclosure relates to a vehicle control device which is provided with multiple computing units.

BACKGROUND ART

In a recent electronically-controlled vehicle, its reliability and stability are ensured by technology disclosed by Patent Literature 1 (JP H6-50851 A), for example. The disclosed apparatus is provided with an in-vehicle data storage unit and a diagnostic unit. The in-vehicle data storage unit reads and stores input-output data of an in-vehicle electronic control unit. The diagnostic unit reads the data stored in the in-vehicle data storage unit, and compares the data with specified criterion value to determine whether a failure exists.

A vehicle control system is provided with multiple computing units, such as a computing unit (electronic control unit) which controls an engine, a computing unit which controls a transmission, and a computing unit which controls an Air-Con (air-conditioner). In a case that each computing unit has an abnormality-diagnosis circuit, it is likely that a requirement of cost reduction may not be satisfied, which is an important technological issue.

The present applicant has been researching a vehicle control system in which an output signal of a first computing unit is input into a second computing unit to determine whether the output signal of the first computing unit is normal by the second computing unit (input computing unit), whereby an abnormality diagnosis of the first computing unit (output computing unit) is performed. In the above research process, following new subjects has become clear.

Due to some causes (for example, data corruption of ROM etc.), it is likely that a criterion value for the abnormality diagnosis of the first computing unit may become an abnormal value. When the abnormality diagnosis of the first computing unit is performed based on the abnormal criterion value, it is more likely that the abnormality diagnosis of the first computing unit may be erroneously performed. Since the abnormality of the criterion value is undetectable without a monitoring function for monitoring the criterion value, an erroneous abnormality diagnosis cannot be avoided, so that an accuracy of the abnormality diagnosis may deteriorate. Also, the above Patent Literature 1 does not disclose a technology to monitor the criterion value.

PRIOR ART LITERATURE

Patent Literature

Patent Literature 1: JP H6-50851 A

SUMMARY OF INVENTION

It is an object of the present disclosure to provide a vehicle control device in which a second computing unit performs an abnormality diagnosis of a first computing unit and an abnormality-diagnosis accuracy of a first computing unit is improved.

According to an aspect of the present disclosure, a vehicle control device has a first computing unit and a second computing unit, and an output signal of the first computing unit is input into the second computing unit. The vehicle control device includes an abnormality-diagnosis unit provided to the second computing unit, performing an abnormality diagnosis of the first computing unit by determining whether the output signal of the first computing unit is normal by means of a specified criterion value, and a monitoring unit determining whether the specified criterion value is normal, besides the abnormality-diagnosis unit.

With the above configuration, since the monitoring unit determines whether the criterion value is normal, the abnormality of the criterion value can be detected even if the criterion value becomes an abnormal value. Thus, it can be avoided that the abnormality diagnosis is performed erroneously due to the abnormal criterion value, so that an abnormality-diagnosis accuracy of the first computing unit can be improved.

BRIEF DESCRIPTION OF DRAWINGS

The above and other objects, features and advantages of the present disclosure will become more apparent from the following detailed description made with reference to the accompanying drawings.

EMBODIMENT FOR CARRYING OUT INVENTION

An embodiment will be described hereinafter.

Figure 1:
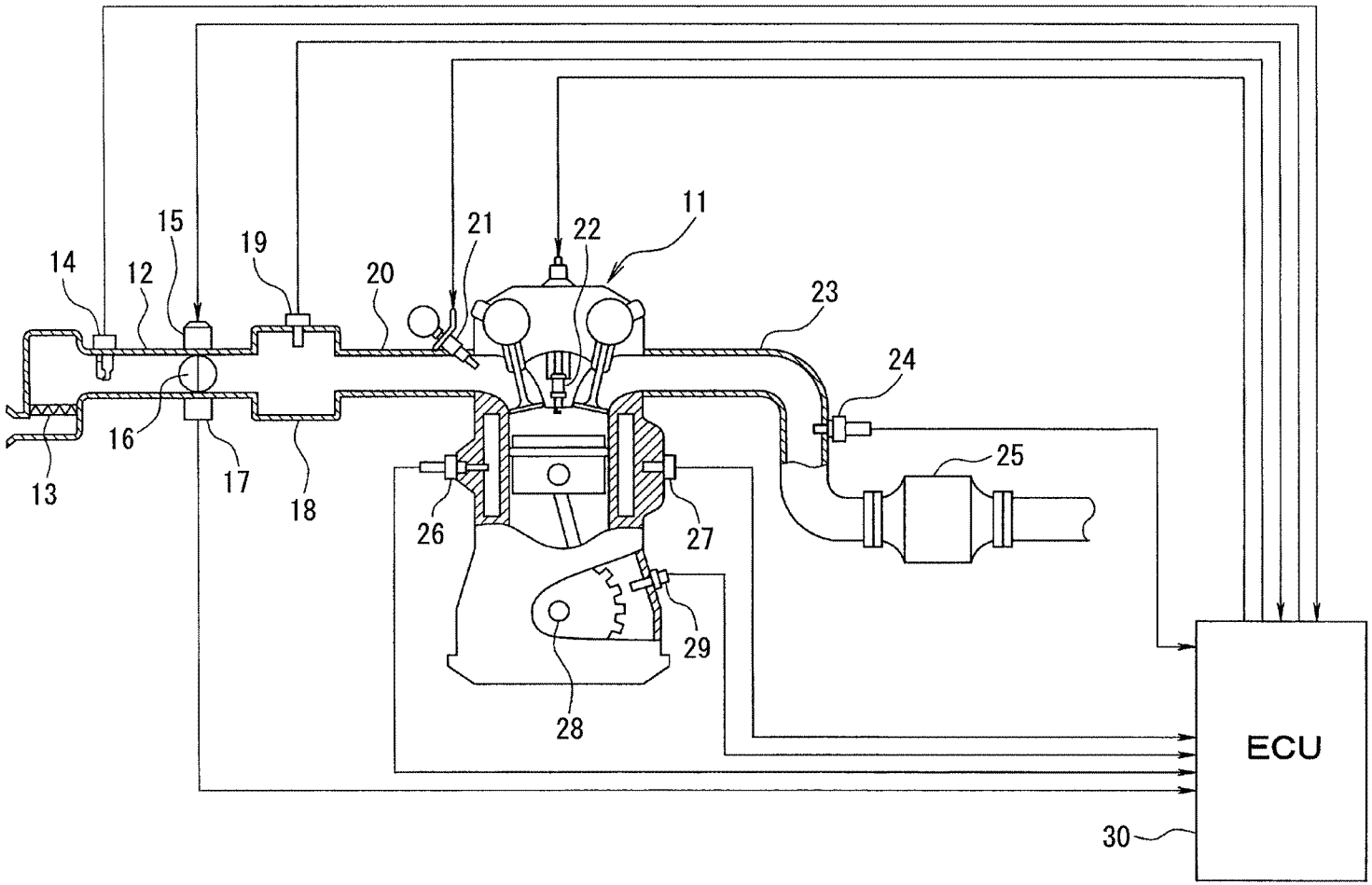
FIG. 1 is a schematic view of an engine control system according to an embodiment of the present disclosure.

Referring to FIG. 1, a configuration of an engine control system is schematically explained.

An air cleaner 13 is arranged upstream of an intake pipe 12 of an internal combustion engine 11 mounted on a vehicle. An airflow meter 14 detecting an intake air flow rate is provided downstream of the air cleaner 13. A throttle valve 16 driven by a DC-motor 15 and a throttle position sensor 17 detecting a throttle position (throttle opening degree) are provided downstream of the air flow meter 14.

A surge tank 18 including an intake air pressure sensor 19 is provided downstream of the throttle valve 16. The intake air pressure sensor 19 detects intake air pressure. An intake manifold 20 introducing air into each cylinder of the engine 11 is provided downstream of the surge tank 18, and the fuel injector 21 injecting the fuel into an intake port is provided at a vicinity of the intake port connected to the intake manifold 20 of each cylinder. Alternatively, a fuel injector may be provided on an upper portion of each cylinder of the engine 11 to inject fuel directly into the cylinder. A spark plug 22 is mounted on a cylinder head of the engine 11 corresponding to each cylinder to ignite air-fuel mixture in each cylinder.

An exhaust gas sensor (an air fuel ratio sensor, an oxygen sensor, etc.) 24 which detects an air-fuel ratio of the exhaust gas is respectively provided in each exhaust pipe 23, and a three-way catalyst 25 which purifies the exhaust gas is provided downstream of the exhaust gas sensor 24.

A coolant temperature sensor 26 detecting a coolant temperature and a knock sensor 27 detecting knocking of the engine are disposed on a cylinder block of the engine 11. A crank angle sensor 29 is installed on a cylinder block to output crank angle pulses when a crank shaft 28 rotates a predetermined angle. Based on this crank angle pulses, a crank angle and an engine speed are detected. Furthermore, an accelerator position (control input of an accelerator pedal) is detected by an accelerator sensor 31 (refer to FIG. 2), and a brake operation is detected by the brake switch 32 (refer to FIG. 2) (alternatively, brake operation amount is detected by a brake sensor).

The output of these sensors and the switches are inputted into an engine ECU 30. The engine ECU 30 includes a microcomputer which executes an engine control program stored in a Read Only Memory (ROM) to control a fuel injection quantity, an ignition timing, a throttle position (intake air quantity) and the like.

Figure 2:
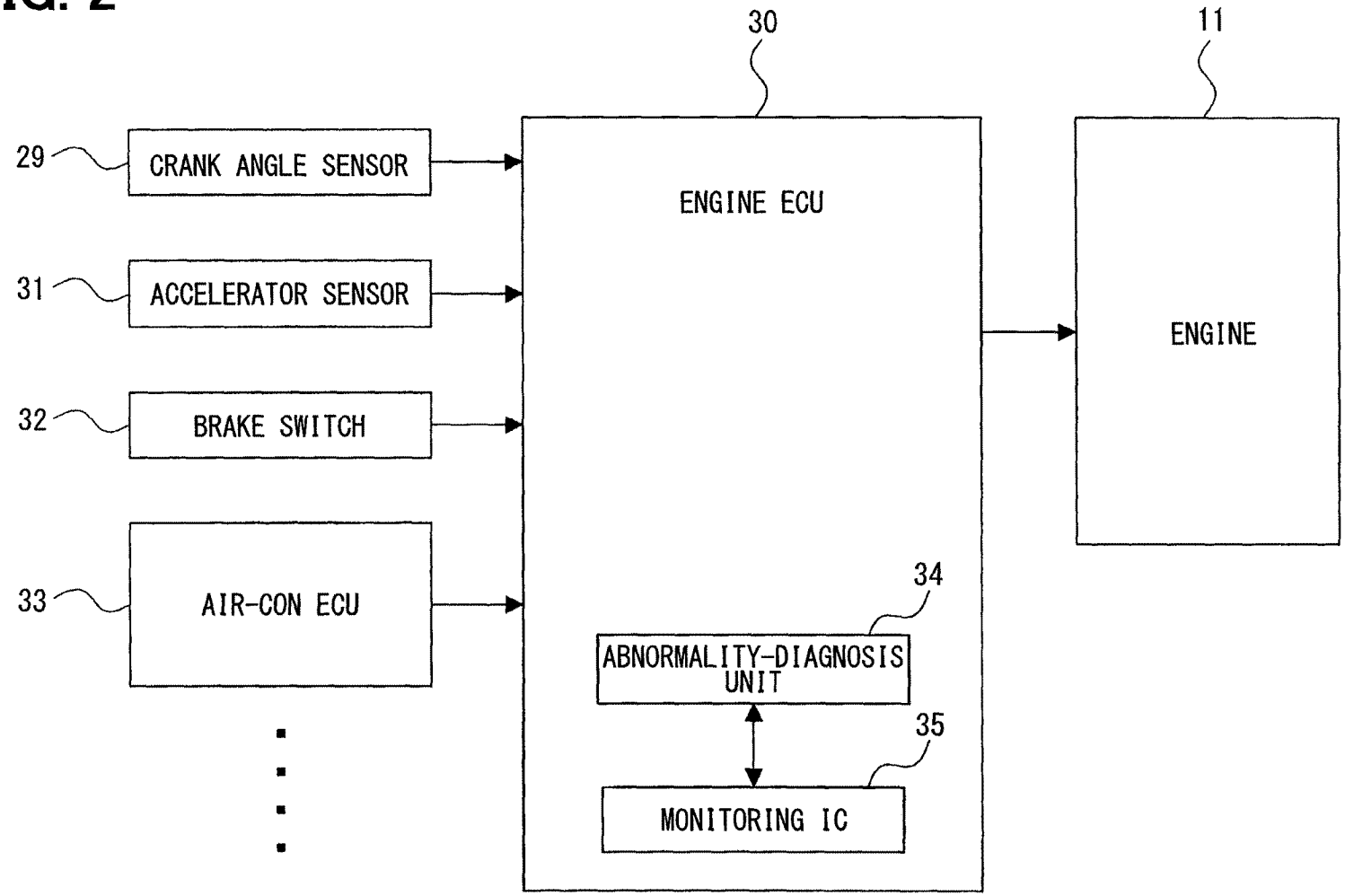
FIG. 2 is a block diagram schematically showing a functional configuration of an engine ECU.

As shown in FIG. 2, the information (such as control signals, data signals, etc.) is mutually transmitted between the engine ECU 30 and an Air-Con ECU 33 which controls an Air-Con (air-conditioner) carried on a vehicle through CAN communication and the like. Moreover, the information is mutually transmitted also between the engine ECU 30 and other ECU (for example, an AT-ECU controlling a transmission, a brake ECU controlling a brake, etc.) carried on a vehicle, through CAN communication and the like.

The Air-Con ECU 33 calculates a required torque-up value based on an operational condition of the Air-Con, and outputs a signal corresponding to the required torque-up value. The output signal (required torque-up value etc.) of the Air-Con ECU 33 is inputted into the engine ECU 30. According to the present embodiment, the Air-Con ECU 33 corresponds to a first computing unit, and the engine ECU 30 corresponds to a second computing unit.

The engine ECU 30 calculates a required torque based on the output signals of the crank angle sensor 29, the accelerator sensor 31, the brake switch 32, and the Air-Con ECU 33. Furthermore, based on the required torque, the engine ECU 30 calculates engine control parameters (the target throttle position, the fuel injection quantity, the ignition timing, etc.) to control the engine 11 (the throttle valve 16, the fuel injector 21, the ignition plug 22, etc.)

Moreover, the engine ECU 30 is provided with an abnormality-diagnosis unit 34 which performs an abnormality diagnosis of the Air-Con ECU 33, and a monitoring IC 35 (monitoring unit) which monitors the abnormality-diagnosis unit 34, on another circuit board.

The abnormality-diagnosis unit 34 determines whether the output signal of the Air-Con ECU 33 is normal based on the specified criterion value, so that the abnormality diagnosis of the Air-Con ECU 33 is performed. At the same time, the monitoring IC 35 determines whether the criterion value is normal, which is used during the abnormality diagnosis of the Air-Con ECU 33. Moreover, the abnormality-diagnosis unit 34 performs an abnormality diagnosis of the monitoring IC 35.

When the abnormality diagnosis of the Air-Con ECU 33 is performed based on the criterion value which the monitoring IC 35 determines abnormal, it is likely that the abnormality diagnosis may be performed erroneously. Thus, when the monitoring IC 35 determines that the criterion value is abnormal, the engine ECU 30 prohibits the abnormality diagnosis of the Air-Con ECU 33. The engine ECU 30 performs a specified operation for abnormality.

Also, when the abnormality-diagnosis unit 34 determines that the monitoring IC 35 is abnormal, it is likely that the monitoring IC 35 may erroneously determine the criterion value is normal even though the criterion value is abnormal. In such a condition, when the abnormality diagnosis of the Air-Con ECU 33 is performed, it is likely that an erroneous diagnosis may be performed. Thus, when the abnormality-diagnosis unit 34 determines that the monitoring IC 35 is abnormal, the engine ECU 30 prohibits the abnormality diagnosis of the Air-Con ECU 33. The engine ECU 30 performs a specified operation for abnormality.

Meanwhile, when the monitoring IC 35 determines that the criterion value is normal and the abnormality-diagnosis unit 34 determines that the monitoring IC 35 is normal, the abnormality diagnosis of the Air-Con ECU 33 is permitted. The abnormality-diagnosis unit 34 determines whether the output signal of the Air-Con ECU 33 is normal by comparing the output signal of the Air-Con ECU 33 with the criterion value. The criterion value is at least one of an upper limit determination value, a lower limit determination value, a variation determination value of the Air-Con ECU 33 or a calculated value which simulates the output signal of the Air-Con ECU 33. (The calculated value is the same value as a value which the abnormality-diagnosis unit 34 calculates.)

As a result, when it is determined that the output signal of the Air-Con ECU 33 is normal, it is determined that the Air-Con ECU 33 is normal. On the other hands, when it is determined that the output signal of the Air-Con ECU 33 is abnormal, it is determined that the Air-Con ECU 33 is abnormal. The Air-Con ECU 33 performs a specified operation for abnormality.

Figure 3:
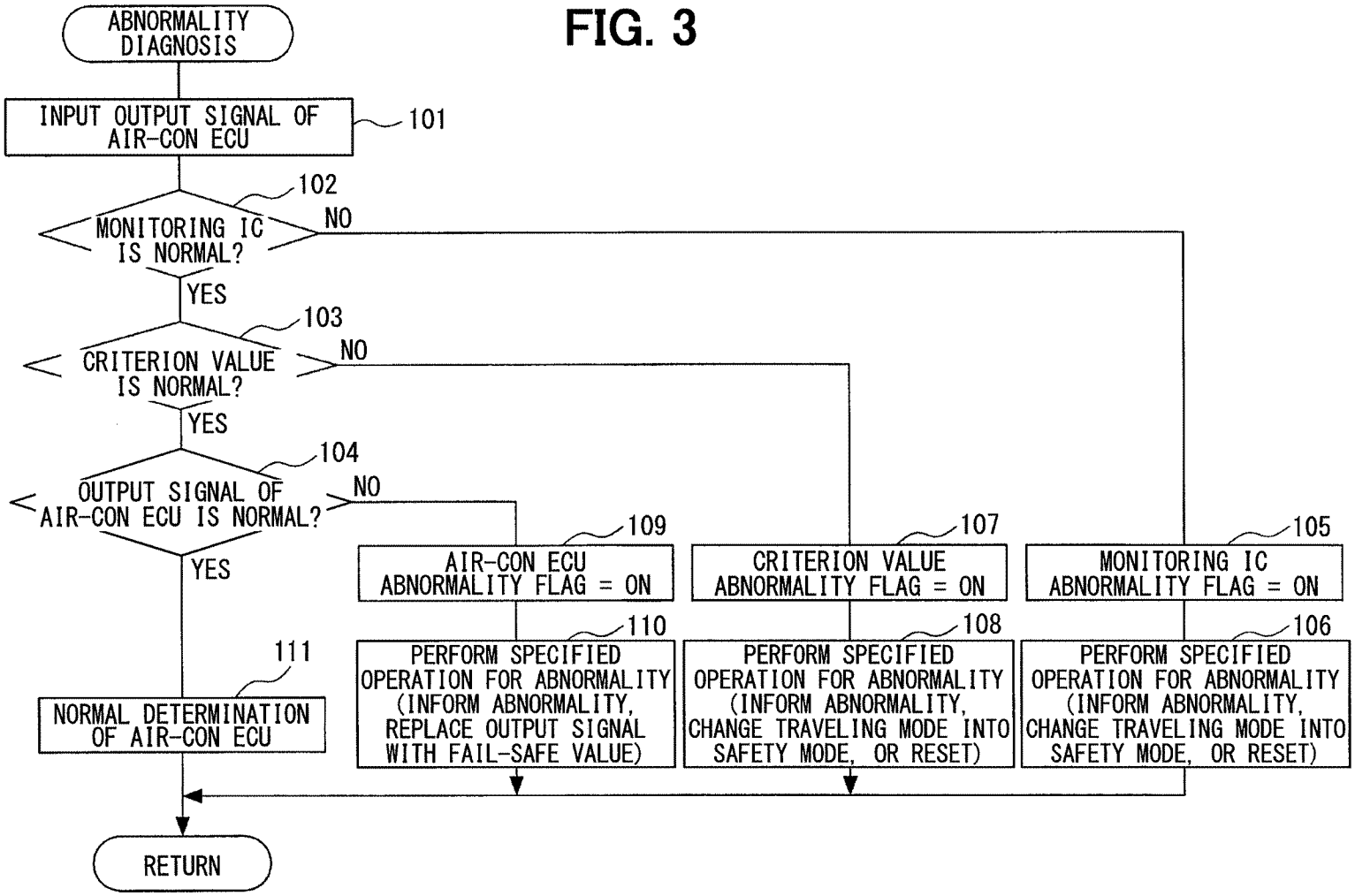
FIG. 3 is a flow chart showing a processing of an abnormality diagnosis routine.

The above described abnormality diagnosis of the Air-Con ECU 33 is executed by the engine ECU 30 according to an abnormality diagnosis routine shown in FIG. 3. The process of this routine will be described hereinafter.

The abnormality diagnosis routine shown in FIG. 3 is executed at specified intervals while the engine ECU 30 is ON. In step 101, the engine ECU 30 receives the output signal of the Air-Con ECU 33.

Then, the procedure proceeds to step 102 in which it is determined whether the monitoring IC 35 is normal. In this case, for example, the abnormality-diagnosis unit 34 transmits test data into the monitoring IC 35, and the monitoring IC 35 transmits the calculated result of the test data into the abnormality-diagnosis unit 34. The abnormality-diagnosis unit 34 checks the calculated result of the monitoring IC 35, and determines whether the monitoring IC 35 is abnormal or not.

When it is determined that the monitoring IC 35 is abnormal in step 102, the abnormality diagnosis of the Air-Con ECU 33 may be erroneously determined. Thus, the abnormality diagnosis of the Air-Con ECU 33 is prohibited.

In this case, the procedure proceeds to step 105 in which an abnormality flag is set "ON" and abnormality information (abnormality codes) is stored in a nonvolatile memory, such as a backup RAM (not shown) of the engine ECU 30.

Then, the procedure proceeds to step 106 in which the specified operation for abnormality is performed to end the routine. In the specified operation for abnormality, a driver is informed of the malfunction. Specifically, a warning lamp (not shown) arranged on an instrument panel for a driver is turned ON or blinked. Alternatively, an alarm display (not shown) on the instrument panel is turned ON. Furthermore, as the specified operation for abnormality, a traveling mode of a vehicle is changed into a safety mode (for example, a vehicle speed or an engine output is decreased). Alternatively, the engine ECU 30 is reset (restarted).

Meanwhile, when it is determined that the monitoring IC 35 is normal in step 102, the procedure proceeds to step 103 in which it is determined whether the criterion value for performing the abnormality diagnosis of the Air-Con ECU 33 is normal.

In a case that the criterion value is stored in the ROM or the RAM of the abnormality-diagnosis unit 34, the monitoring IC 35 checks the ROM or RAM of the abnormality-diagnosis unit 34 so as to determine whether the data stored in the ROM or the RAM are normal, whereby it is determined whether the criterion value is normal.

Alternatively, in a case that the abnormality-diagnosis unit 34 calculates the criterion value, the monitoring IC 35 checks a flow of the abnormality-diagnosis unit 34 so as to determine a calculation function of the abnormality-diagnosis unit 34 is normal, whereby it is determined whether the criterion value is normal.

When it is determined that the criterion value is abnormal in step 103, the abnormality diagnosis of the Air-Con ECU 33 may be erroneously determined. Thus, the abnormality diagnosis of the Air-Con ECU 33 is prohibited.

In this case, the procedure proceeds to step 107 in which the abnormality flag is set "ON" and abnormality information (abnormality codes) is stored in a nonvolatile memory, such as a backup RAM (not shown) of the engine ECU 30.

Then, the procedure proceeds to step 108 in which the specified operation for abnormality is performed to end the routine. In the specified operation for abnormality, a driver is informed of the malfunction. Furthermore, the traveling mode of the vehicle is changed into the safety mode. Alternatively, the engine ECU 30 is reset.

Meanwhile, when it is determined that the monitoring IC 35 is normal in step 102 and the criterion value is normal in step 103, the abnormality diagnosis of the Air-Con ECU 33 is permitted.

The procedure proceeds to step 104 in which it is determined whether the output signal of the Air-Con ECU 33 is normal by comparing the output signal of the Air-Con ECU 33 with the criterion value.

In a case that the upper limit determination value and the lower limit determination value of the output signal of the Air-Con ECU 33 are used as the criterion value for example, it is determined whether the output signal of the Air-Con ECU 33 is normal by determining whether the output signal of the Air-Con ECU 33 is within a normal range (not less than the lower limit determination value and not more than the upper limit determination value).

Alternatively, in a case that the variation determination value of the Air-Con ECU 33 is used as the criterion value, it is determined whether the output signal of the Air-Con ECU 33 is normal by determining whether the variation in the output signal of the Air-Con ECU 33 is not more than the variation determination value.

Moreover, in a case that a calculation value (a value calculated by the abnormality-diagnosis unit 34) simulating the output signal of the Air-Con ECU 33 is used as the criterion value, it is determined whether the output signal of the Air-Con ECU 33 is normal by determining whether a difference between the output signal of the Air-Con ECU 33 and the calculation value is not more than a specified value.

It should be noted that the method of determining whether the output of the ECU 33 is normal is not limited to the method mentioned above, but may be changed suitably. For example, when two or three of the following conditions are established, it may be determined that the output signal of the Air-Con ECU 33 is normal:

(1) The output signal of the Air-Con ECU 33 is within the normal range;

(2) The variation in the output signal of the Air-Con ECU 33 is not more than the variation determination value; and (3) The difference between the output signal of the Air-Con ECU 33 and the calculation value is not more than the specified value.

When it is determined that the output signal of the Air-Con ECU 33 is abnormal in step 104, the procedure proceeds to step 109 in which it is determined that the Air-Con ECU 33 is abnormal and the abnormality flag is set "ON". The abnormality information (abnormality codes) is stored in a nonvolatile memory, such as the backup RAM of the engine ECU 30.

Then, the procedure proceeds to step 110 in which the specified operation for abnormality is performed to end the routine. In the specified operation for abnormality, a driver is informed of the malfunction. Furthermore, the output signal of the Air-Con ECU 33 is replaced with a fail-safe value.

On the other hands, when it is determined that the output signal of the Air-Con ECU 33 is normal in step 104, the procedure proceeds to step 111 in which it is determined that the Air-Con ECU 33 is normal to end the routine.

According to the present embodiment described above, the engine ECU 30 is provided with the abnormality-diagnosis unit 34 which determines whether the output signal of the Air-Con ECU 33 is normal by comparing the output signal of the Air-Con ECU 33 with the criterion value, whereby the abnormality diagnosis of the Air-Con ECU 33 is performed. Furthermore, the engine ECU 30 is provided with the monitoring IC 35 on another circuit board, which determines whether the criterion value is normal for performing the abnormality diagnosis of the Air-Con ECU 33. Thus, since the monitoring IC 35 determines whether the criterion value is normal, the abnormality of the criterion value can be detected even if the criterion value becomes an abnormal value. It can be avoided that the abnormality diagnosis is performed erroneously due to the abnormal criterion value, so that an abnormality-diagnosis accuracy of the Air-Con ECU 33 can be improved.

Moreover, according to the present embodiment, the abnormality-diagnosis unit performs an abnormality diagnosis of the monitoring IC 35. The abnormality-diagnosis unit 34 monitors the monitoring IC 35 to ensure an operation of the monitoring IC 35.

Also, when the abnormality diagnosis of the Air-Con ECU 33 is performed based on the criterion value which the monitoring IC 35 determines abnormal, it is likely that the abnormality diagnosis of the Air-Con ECU 33 may be performed erroneously. Thus, according to the present embodiment, when the monitoring IC 35 determines that the criterion value is abnormal, the abnormality diagnosis of the Air-Con ECU 33 is prohibited. An erroneous diagnosis due to abnormal criterion value can be prevented.

Meanwhile, when the abnormality-diagnosis unit 34 determines that the monitoring IC 35 is abnormal, it is likely that the monitoring IC 35 erroneously determines that the criterion value is normal even though the criterion value is abnormal. In such a situation, when the abnormality diagnosis of the Air-Con ECU 33 is performed, it is likely that the abnormality diagnosis of the Air-Con ECU 33 is erroneously performed. According to the present embodiment, when the abnormality-diagnosis unit 34 determines that the monitoring IC 35 is abnormal, the abnormality diagnosis of the Air-Con ECU 33 is prohibited. An erroneous diagnosis due to the abnormality of the monitoring IC 35 can be prevented.

According to the present embodiment, when the monitoring IC 35 determines that the criterion value is abnormal or the abnormality-diagnosis unit 34 determines that the monitoring IC 35 is abnormal, the operation for abnormality is performed. Thus, when it is determined that the criterion value is abnormal or the monitoring IC 35 is abnormal, the appropriate operation can be performed.

In such a situation, according to the present embodiment, the traveling mode of the vehicle is changed into the safety mode or the engine ECU 30 is reset. When the traveling mode of the vehicle is changed into the safety mode, the vehicle can safely travel to a maintenance factory. When the engine ECU 30 is reset, the abnormality of the criterion value and the abnormality of the monitoring IC 35 can be canceled, so that the engine ECU 30 can be returned to the normal condition.

Moreover, according to the present embodiment, at least one of the upper limit determination value, the lower limit determination value, the variation determination value of the Air-Con ECU 33 and the calculated value simulating the output signal of the Air-Con ECU 33 is used as the criterion value for performing the abnormality diagnosis of the Air-Con ECU 33. With this configuration, it can be easily determined whether the output signal of the Air-Con ECU 33 is normal by comparing the output signal of the Air-Con ECU 33 with the criterion value.

Furthermore, according to the present embodiment, when the abnormality-diagnosis unit 34 determines that the output signal of the Air-Con ECU 33 is abnormal, it is determined that the Air-Con ECU 33 is abnormal, so that the operation for abnormality is performed. With this configuration, when it is determined that the output signal of the Air-Con ECU 33 is abnormal, the appropriate operation for abnormality can be performed.

According to the present embodiment, the output signal of the Air-Con ECU 33 is replaced with a fail-safe value, as the operation for abnormality. Thus, the vehicle control can be continued with the fail-safe value.

Moreover, according to the present embodiment, when it is determined that the criterion value is abnormal or the monitoring IC 35 is abnormal or when it is determined that the output signal of the Air-Con ECU 33 is abnormal, a driver is informed of the malfunction. Thereby, the driver is promptly informed of the malfunction to perform a checking and a repairing of a vehicle in a maintenance factory.

In the above described embodiment, the engine ECU 30 has the monitoring IC 35 therein. However, the monitoring IC 35 can be disposed outside of the engine ECU 30 independently.

Moreover, in the above described embodiment, the abnormality-diagnosis unit of the engine ECU determines whether the output signal of the Air-Con ECU is normal. However, the abnormality-diagnosis unit of the engine ECU can determine whether a vehicle-mounting ECU (for example, an AT-ECU, a brake ECU, etc.) other than the Air-Con ECU is normal. Alternatively, an abnormality-diagnosis unit of a vehicle-mounting ECU other than the engine ECU can determine whether an output signal of another vehicle-mounting ECU is normal.

This disclosure is described according to the embodiments. However, it is understood that this disclosure is not limited to the above embodiments or the structures. This disclosure includes various modified examples, and modifications falling within an equivalent range. In addition, various combinations or configurations as well as other combinations or configurations including only one element, or more than or lower than one element therein also fall within a category and a conceptual range of this disclosure.

The invention claimed is:

1. A vehicle control device in which an output signal of a first computing unit is input into a second computing unit, the vehicle control device comprising:

an abnormality-diagnosis unit provided to the second computing unit, the abnormality-diagnosis unit including memory storing instructions and a computer processor for executing the instructions such that the abnormality-diagnosis unit is configured to perform an abnormality diagnosis of the first computing unit by determining whether the output signal of the first computing unit is normal by means of a specified criterion value, and a monitoring IC configured to monitor the abnormality-diagnosis unit and determine whether the specified criterion value is normal, besides the abnormality-diagnosis unit.

2. A vehicle control device according to claim 1, wherein the second computing unit prohibits the abnormality diagnosis of the first computing unit when the monitoring IC determines that the specified criterion value is abnormal.

3. A vehicle control device according to claim 1, wherein the second computing unit performs a specified operation for abnormality when the monitoring IC determines that the specified criterion value is abnormal.

4. A vehicle control device according to claim 3, wherein the second computing unit performs the specified operation for abnormality in which the second computing unit is reset or a traveling mode of a vehicle is changed into a safety mode.

5. A vehicle control device according to claim 3, wherein the second computing unit informs a driver of a malfunction, as the specified operation for abnormality.

6. A vehicle control device according to claim 1, wherein the abnormality-diagnosis unit is further configured to determine whether the monitoring IC is normal.

7. A vehicle control device according to claim 6, wherein the second computing unit prohibits the abnormality diagnosis of the first computing unit when the abnormality-diagnosis unit determines that the monitoring IC is abnormal.

8. A vehicle control device according to claim 6, wherein the second computing unit performs the specified operation for abnormality when the abnormality-diagnosis unit determines that the monitoring IC is abnormal.

9. A vehicle control device according to claim 1, wherein the abnormality-diagnosis unit is further configured to use an upper limit determination value, a lower limit determination value, a variation determination value of the first computing unit and/or a calculated value simulating the output signal of the first computing unit, as the specified criterion value.

10. A vehicle control device according to claim 1, wherein the second computing unit determines that the first computing unit is abnormal and performs the specified operation for abnormality when the abnormality-diagnosis unit determines that the output signal of the first computing unit is abnormal.

11. A vehicle control device according to claim 10, wherein the second computing unit replaces the output signal of the first computing unit with a fail-safe value, as the specified operation for abnormality.

12. A vehicle control device according to claim 1, wherein the monitoring IC is on an other circuit board than the abnormality-diagnosis unit.

13. A vehicle control device according to claim 12, wherein the abnormality-diagnosis unit determines whether the monitoring unit is normal, and the abnormality-diagnosis unit performs the abnormality diagnosis of the first computing unit on determination that the monitoring IC is normal and on determination of the monitoring IC that the abnormality-diagnosis unit is normal.

14. A vehicle control device according to claim 13, wherein the abnormality-diagnosis unit is further configured to determine whether the output signal of the first computing unit is normal by comparing the output signal of the first computing unit with the specified criterion value.

15. A vehicle control device according to claim 14, wherein the abnormality-diagnosis unit determines whether the monitoring IC is normal by transmitting test data into the monitoring IC, receiving a calculated result of the test data from the monitoring IC, and checking the calculated result of the monitoring IC.

16. A vehicle control device according to claim 1, wherein the abnormality-diagnosis unit has the specified criterion value and determines whether the output signal of the first computing unit is normal by comparing the output signal of the first computing unit with the specified criterion value, and the monitoring IC monitors the abnormality-diagnosis unit by determining whether the specified criterion value is normal.

17. A vehicle control device according to claim 1, wherein the second computing unit is an engine ECU configured to control at least one of a fuel injection quantity, an ignition timing, or an intake air quantity of an internal combustion engine.

* * * * *